US005728030A

United States Patent [19]

Hsieh

[11] Patent Number: 5,728,030

[45] Date of Patent: Mar. 17, 1998

[54] INFANT TRAINING WALKER

[76] Inventor: Charles Ping-Chao Hsieh, 263 W. Las Flores Dr., Arcadia, Calif. 91006

[21] Appl. No.: 681,853

[22] Filed: Jul. 29, 1996

[51] Int. Cl.[6] ..... A63B 22/00; A47D 13/04

[52] U.S. Cl. ..... 482/66; 482/51; 482/54; 472/15

[58] Field of Search ..... 482/66, 51, 57, 482/69, 72, 54; 472/15, 14

[56] References Cited

U.S. PATENT DOCUMENTS

| | | | |
|---|---|---|---|
| 1,521,946 | 1/1925 | Hargreaves | 482/54 |
| 4,743,008 | 5/1988 | Fermaglich | 482/51 |
| 5,056,776 | 10/1991 | Cheng | 482/66 |
| 5,302,163 | 4/1994 | Fermaglich | 482/66 |
| 5,382,033 | 1/1995 | Cheu | 482/54 |
| 5,433,682 | 7/1995 | Fermaglich | 482/66 |
| 5,518,475 | 5/1996 | Garland | 482/66 |

*Primary Examiner*—R. J. Aoley
*Assistant Examiner*—William LaMarca
*Attorney, Agent, or Firm*—Terrell P. Lewis

[57] ABSTRACT

An infant training walker has a base platform, a disk-shaped tread member rotatably supported approximately flush therewith, and a belt-shaped restraint spaced above the platform in eccentric relation to the tread member for laterally restraining an occupant of the walker. Preferably, a seat element having leg openings depends from the restraint, and the restraint is rotatable within a tray having an array of toy elements. Thus the occupant is encouraged to exercise in a variety of angular orientations relative to the tread member. The occupant can walk with both feet on the tread member, and can also keep one foot on the platform while moving the other foot on the tread member. The tray is adjustable in height, being supported from the platform on telescoping legs. A vertically extending seat back attachment can augment a back-supporting portion of the restraint when the walker is used by larger toddlers. The walker can also be adapted for use as a play room table, either by adding a tray cover after removing the restraint therefrom, or by inverting the walker with the tray removed and adding a platform cover.

23 Claims, 4 Drawing Sheets

FIG. 1
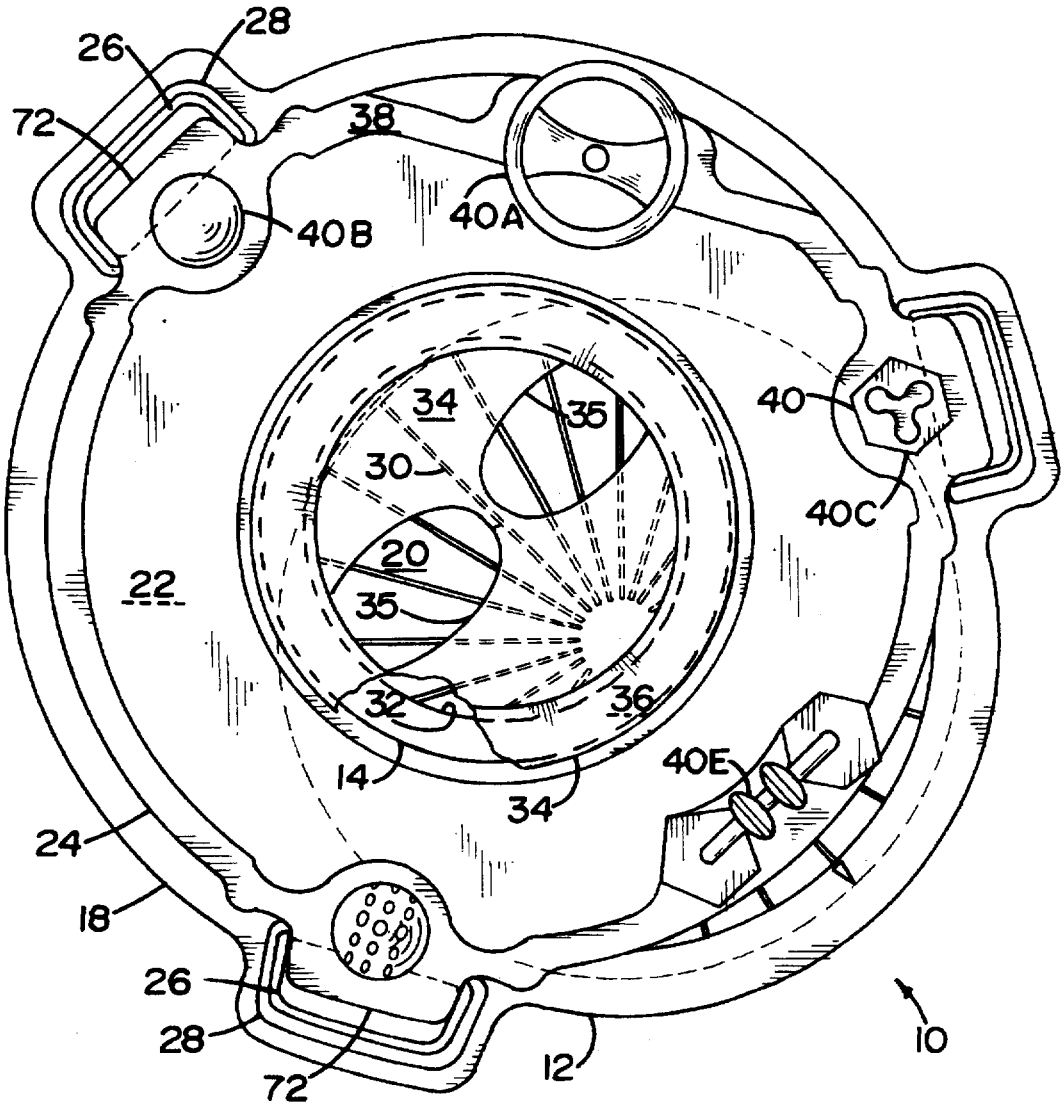
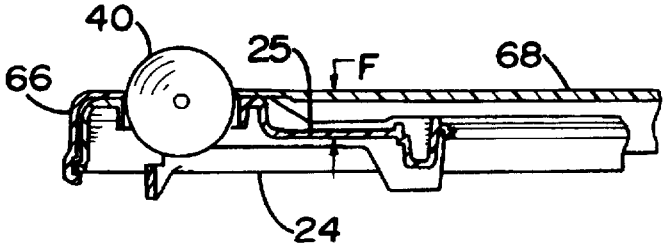
FIG. 6

INFANT TRAINING WALKER

BACKGROUND

The present invention relates to infant furniture, and to training devices such as walkers and the like.

A wide variety of infant furniture, including tables, chairs, and the like is commercially available in the prior art. Infant walkers are also known, typical examples being of the type providing elevated handles and/or a seat on a wheeled vehicle that is propelled by the infant as he walks with assistance by the walker. These walkers have not been entirely satisfactory for a number of reasons. For example:

1. They are dangerous in use in that they can be tipped over and/or driven into harmful contact with other room furnishings;

2. They are difficult to use in that the infant must apply sufficient driving force to move the device;

3. They are expensive to use in that they require excessive room for maneuvering;

4. They have limited utility in that infants often loose interest after only a short period of use; and 5. They have use limited to particularly sized infants, being of little practical use when such infants grow to larger sizes.

Thus there is a need for an infant walker that overcomes the disadvantages of the prior art.

SUMMARY

The present invention meets this need by providing a stationary infant walker that is easy and interesting to use during significant infant and toddler growth stages. In one aspect of the invention, the walker includes a base having a platform or stage surface; a tread member having a tread surface portion movably supported approximately coplanar with the stage surface; and a restraint member for laterally restraining an infant occupant's torso portion and at least partially supporting the infant. The restraint member can include a horizontally disposed belt portion, that defines a clearance opening for the torso portion. Preferably a vertical restraint axis of the clearance opening intersects the tread surface in spaced or eccentric relation to a vertical tread axis of the tread member for enhancing rotational leverage whereby the occupant can easily advance the tread member. Preferably the axes are offset by a distance E that is between 15 and 30 percent of an outside diameter D of the tread member. More preferably, the offset is approximately 25 percent of D. For example, the distance E can be 4.5 inches when the diameter D is 18 inches.

The tread portion can be a substantially planar disk upper surface, and the tread member being preferably supported by a ring that makes sliding annular contact within a major diameter D1 that is not greater than about 85 percent of the diameter D for lowered frictional resistance. The support can be augmented by a second ring member having sliding annular contact that does not extend within a minor diameter not less than about 40 percent of the diameter D. When D is 18 about inches, D1 can be about 14.2 inches and D2 can be about 9.8 inches.

Preferably, an array of accessories having handle elements are spaced about the restraint member for aiding the occupant in turning relative to the base platform. The restraint member is preferably rotatable for further encouraging the infant to face in various directions, thereby getting a variety of exercise while walking or otherwise moving the tread member. Preferably the walker can at least partially support the occupant, such as by including a sling or seat on the restraint member, thereby providing useful exercise for infants not yet fully able to walk. The seat can include a cloth member that is suspended from the belt portion of the restraint member and having leg openings for coupling rotation of the restraint member with that of the occupant. A preferred upwardly and outwardly extending back portion of the restraint member supports a posterior abdomen portion of the occupant. Further, the restraint can have registration surfaces for locating an accessory back-support extension for use with larger toddlers.

The walker can also have a tray member that is rigidly spaced above the base platform on legs, and the legs can be telescopically extendable with latches for adjusting the height of the tray. The platform can also be supported in an inverted position on the legs with the tray removed, an accessory panel for the platform providing a useful table surface. Alternatively, the restraint member can be removed from the tray, and a tray cover can be attached onto the tray for covering the region normally reserved for the occupant and forming a counterpart of the table surface.

DRAWINGS

These and other features, aspects, and advantages of the present invention will become better understood with reference to the following description, appended claims, and accompanying drawings, where:

FIG. 1 is a top plan view of an infant training walker according to the present invention;

FIG. 6 is an elevational view showing a further alternative configuration of the walker of FIG. 1.

DESCRIPTION

Figure 2:
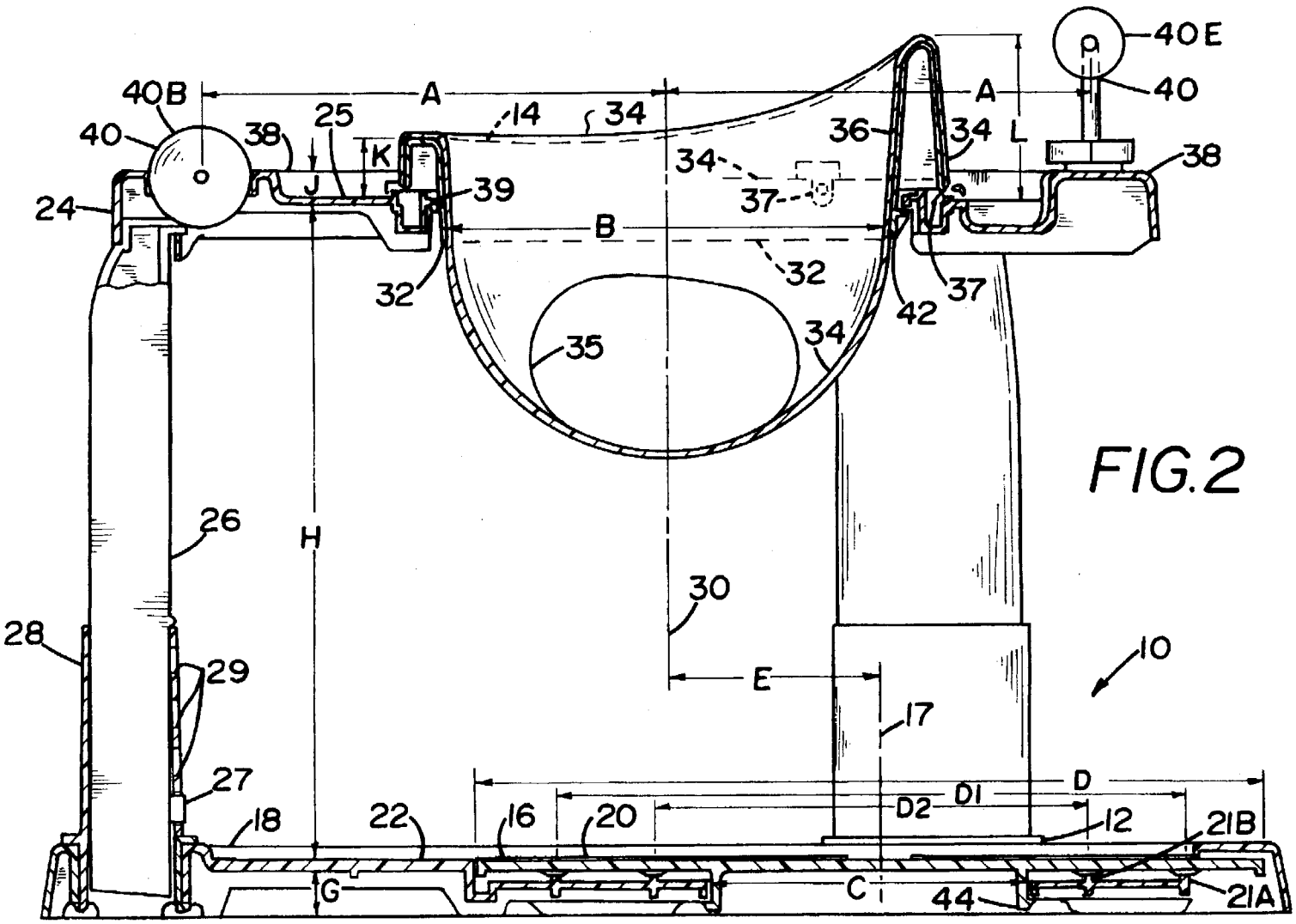
FIG. 2 is fragmentary sectional side view of the walker of FIG. 1.

The present invention is directed to an infant training walker that is particularly safe, useful and versatile over an extended user growth interval. With reference to FIGS. 1 and 2 of the drawings, an infant walker 10 has a frame or base 12, a rotatable body support 14, and a tread member 16 that is movable relative to the base 12 in response to foot movement of an occupant of the support 14. In an exemplary configuration of the walker 10, the base 12 includes a horizontally disposed platform member 18 to which the tread member 16 is rotatably mounted on a vertical tread axis 17, the tread member 16 being approximately circular in outline and having a planar tread surface 20 that is approximately flush with a stage surface 22 of the platform member 18. It will be understood that the tread axis 17 need not be vertical as long as at least a portion of the tread surface 20 is horizontal. Thus while not preferred, the tread axis 17 can be inclined between vertical and horizontal in combination with the tread surface 20 being conical, and the axis 17 can even be horizontal in combination with the tread surface 20 being cylindrical (in the general sense of a surface that is generated by a straight line that moves parallel to a fixed line).

The base 12 also includes a tray member 24 that is adjustably horizontally spaced above the platform member 18 by a plurality of legs 26, the legs 26 being fixably connected to the tray member 24 and telescopically received in respective leg socket members 28 that are rigidly mounted to the platform member 18. Each leg 26 has a push-button latch 27 that selectively engages a vertically spaced plurality of openings 29 that are formed in each socket member 28 for effecting vertical adjustment of the tray member 24. The body support 14 is rotatably mounted to the tray member 24 on a vertical restraint axis 30, the support 14 having a generally ring-shaped belt portion 32 for horizontally supporting an occupant's torso, a seat cloth 34 being suspended from the support 14 and extending in depending relation between opposite sides of the belt portion 32 for supporting an occupant of the apparatus 10. A pair of leg clearance openings 35 are formed on opposite sides of the restraint axis 30, and the seat cloth 34 extends over a raised back portion 36 of the body support 14 for back-support of the occupant. A plurality of clip tabs 37 are sewn into marginal portions of the seat cloth 34 for holding the cloth 34 in place by engagement with projecting portions of the body support 14. The restraint axis 30 is approximately centrally located in both the body support 14 and the tray member 24, a generally circular array of attractive toy elements 40 being supported relative to the tray member 24 in spaced relation to the body support 14. As shown in FIG. 1, an exemplary complement of the elements 40 includes a toy steering wheel 40A, a rotatably mounted ball 40B, a knob sounder 40C, a ball rattle 40D, and a disk bar 40E. It will be understood that while the particular features of the toy elements 40 are not critical, it is preferred that they have sufficient variety and attractiveness to cause the occupant to occasionally rotate the body support 14 to different orientations relative to the tray member 24. For example, a push-button-type horn sounder (not shown) can be provided in place of one of the toy elements 40, or in addition thereto.

In the exemplary embodiment of FIGS. 1 and 2, the. restraint axis 30 is laterally offset by a distance E relative to the tread axis 17, the tread member 16 having an outside diameter D of approximately 18 inches. The tread member 16 makes locating contact with the platform member 18 at a centering diameter C of approximately 7.1 inch, making low-friction load-supporting contact with a plurality of relatively narrow bearing rings 21A and 21B of the platform member 20, facing sliding surfaces of the rings 21A and 21B being smoothly finished low-friction materials. The bearing ring 21A contacts the tread member 16 at a diameter D1 of approximately 14.2 inches, being approximately 79 percent of the diameter D. The bearing ring 21B contacts the tread member 16 at a diameter D2 of approximately 9.8 inches, being approximately 55 percent of the diameter D. Thus the tread member 16 is vertically supported for rotational movement by low-friction contact within an annulus approximately bounded by the diameters D1 and D2. Testing of this configuration using suitable molded engineering plastics for the mating parts confirms that the tread member 16 is freely rotatable by an infant occupant walking thereon, there being only a slight but desirable amount of rotational resistance. It is believed that suitably free movement of the tread member is available using sliding contact within an annulus having an outside diameter that is not more than approximately 85 percent of the diameter D, and that the annulus can have a minor diameter that is at least approximately 40 percent of the diameter D, while it is preferred that the annulus extend between approximately 55 percent and approximately 80 percent of the diameter D.

Further regarding the exemplary configuration of FIGS. 1 and 2, the belt portion of the body support 14 has an inside diameter B of approximately 10 inches, and the toy elements 40 are spaced from the restraint axis by a distance A of approximately 10.83 inches, with the exception of the disk bar 40E being located at a distance A' of approximately 9.4 inches. The tray member 24 has a depressed tray surface 25 that is elevated a height H above the stage surface 22, the surface 22 being elevated a distance G of approximately 1.2 inch above a floor-contacting bottom extremity of the platform member 18. The height H is adjustable by means of the latches 27 between approximately 12.8 inches, 14.2 inches, 15.6 inches, and 17.0 inches, a total G+H being selectable between 14.0 inches, 15.4 inches, 16.8 inches, and 18.2 inches, approximately. The back portion 36 of the body support 14 extends to a height L of approximately 3.8 inches above the tray surface 25, a front half-portion of the body support 14 having a reduced height K of approximately 1.4 inch above the tray surface 25, a marginal portion 38 of the tray member 24 being raised a distance J of approximately 0.6 inch above the tray surface 25.

The belt portion 32 of the body support 18 projects downwardly through a tray opening 39 of the tray member 24, the body support 18 having a plurality of spring catches 42 projecting therefrom for retaining the body support in rotational engagement with the tray member 24. Similarly, counterparts of the spring catches, designated 44, are integrally formed with the tread member 14 for retaining same in rotational engagement with the platform member 18.

A principal feature of the present invention is that the tread member 16 moves in response to lateral reaction forces (circumferential force components) when the occupant walks on it. Preferably, the tread surface 20 extends horizontally away from the tread axis 17 beyond the restraint axis 30 sufficiently to permit the occupant to walk with both feet moving the tread member 16. In the exemplary configuration of FIGS. 1 and 2, the tread surface 20 extends approximately 18/2–4.5=4.5 inches beyond the restraint axis 30, the tread surface 20 extending vertically under virtually all of the space within the belt diameter B. Another important advantage of the walker 10 is that the rotational mounting of the body support 14 permits the occupant to walk in a variety of directions relative to the body support 14, by rotating the body support 14 to different orientations relative to the tray member 24. For example, the orientation of the body support 14 as shown in FIG. 1 is effective for permitting side-step activity by the occupant; whereas an orientation 90° from that shown promotes walking forward and backward. Other orientations of the body support 14 are consistent with diagonal walking. Thus the occupant is encouraged to walk in different directions by virtue of the toy elements 40 being deployed in a variety of angular orientations about the tray member 24. Further, the toy elements 40 facilitate rotation of the body support 14 by providing hand holds for the occupant. Moreover, the occupant can place one foot on the tread surface 20 and the other foot on the stage surface 22 for performing movements akin to riding a skateboard or the like.

Figure 3:
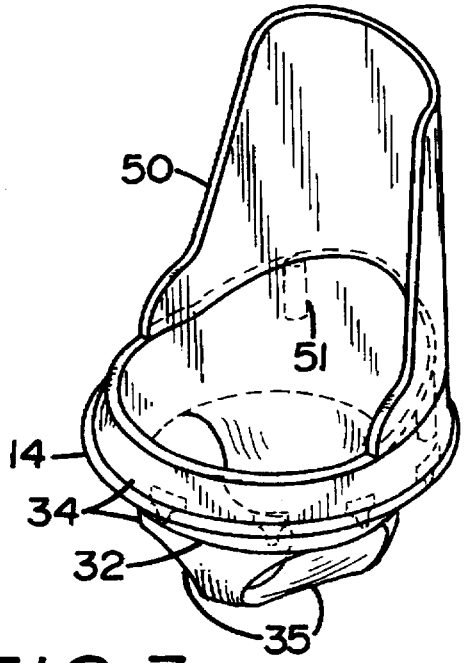
FIG. 3 is an oblique elevational perspective view showing an alternative configuration of a portion of the walker of FIG. 1.
Figure 4:
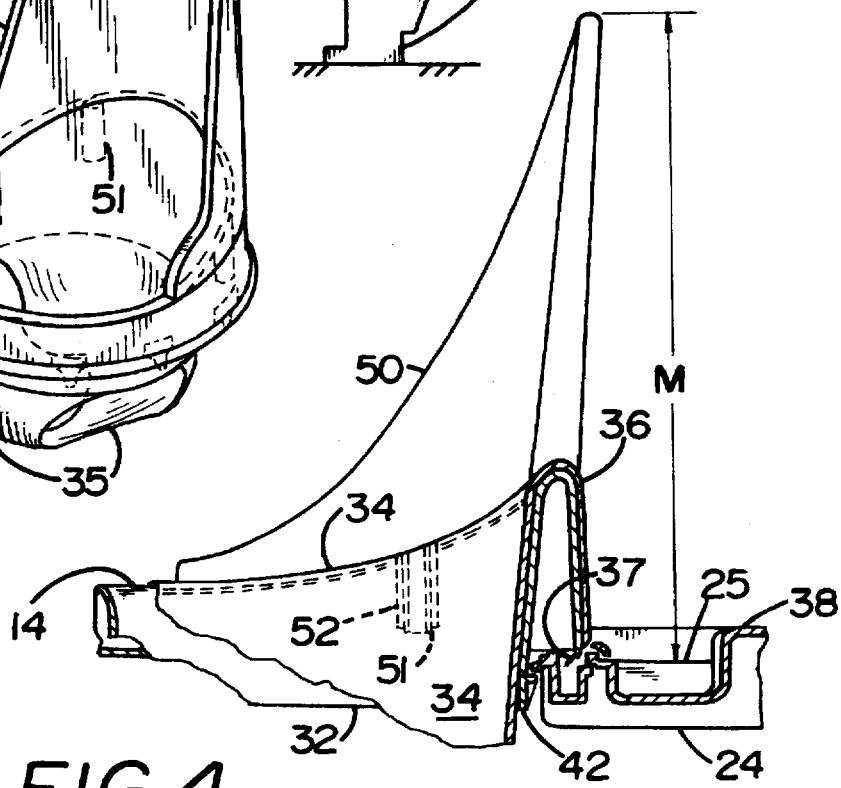
FIG. 4 is a fragmentary sectional elevational view of the walker portion of FIG. 3.

With further reference to FIGS. 3 and 4, an alternative configuration of the walker 10 has the body support 14 adapted for receiving a detachable back-support extension 50, the extension 50 having a pair of locating bosses 51 that engage respective cavities 52 that are formed in the body support 14. The back-support extension 50, which can be held in place using any suitable means, extends above the back portion 36 of the body support 14, to a height M which can be approximately 12 inches, for example, above the tray surface 25.

Figure 5:
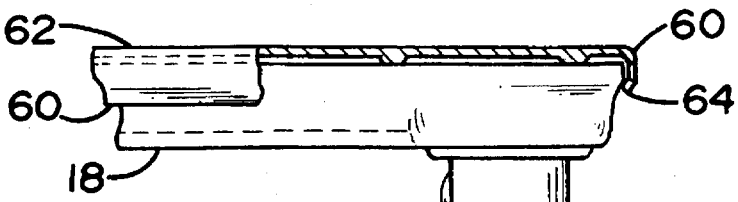
FIG. 5 is an elevational view showing another alternative configuration of the walker of FIG. 1.

With further reference to FIG. 5, the tray member 24 is preferably removable from the legs 26, upper extremities 58 of the legs 26 being adapted for floor contact supporting the platform member 18 in an inverted, elevated position. For example, the legs 26 have locking engagement with the tray member 24 in the configuration of FIGS. 1 and 2, being releasable upon withdrawal of the legs 26 from the respective socket members 28. As further shown in FIG. 5, a platform cover 60 engages inside surfaces of the platform member 18 to provide a table surface 62 when use of the tread member 16 of walker 10 is not desired. Such might be the case, for example, when infants who would be occupants of the walker 10 have grown out of such use. The cover 60 is preferably formed with counterparts of the spring catch, designated 64, for retaining the cover 60 engaged with the platform member 18 in both normal and inverted positions thereof.

Figure 7:
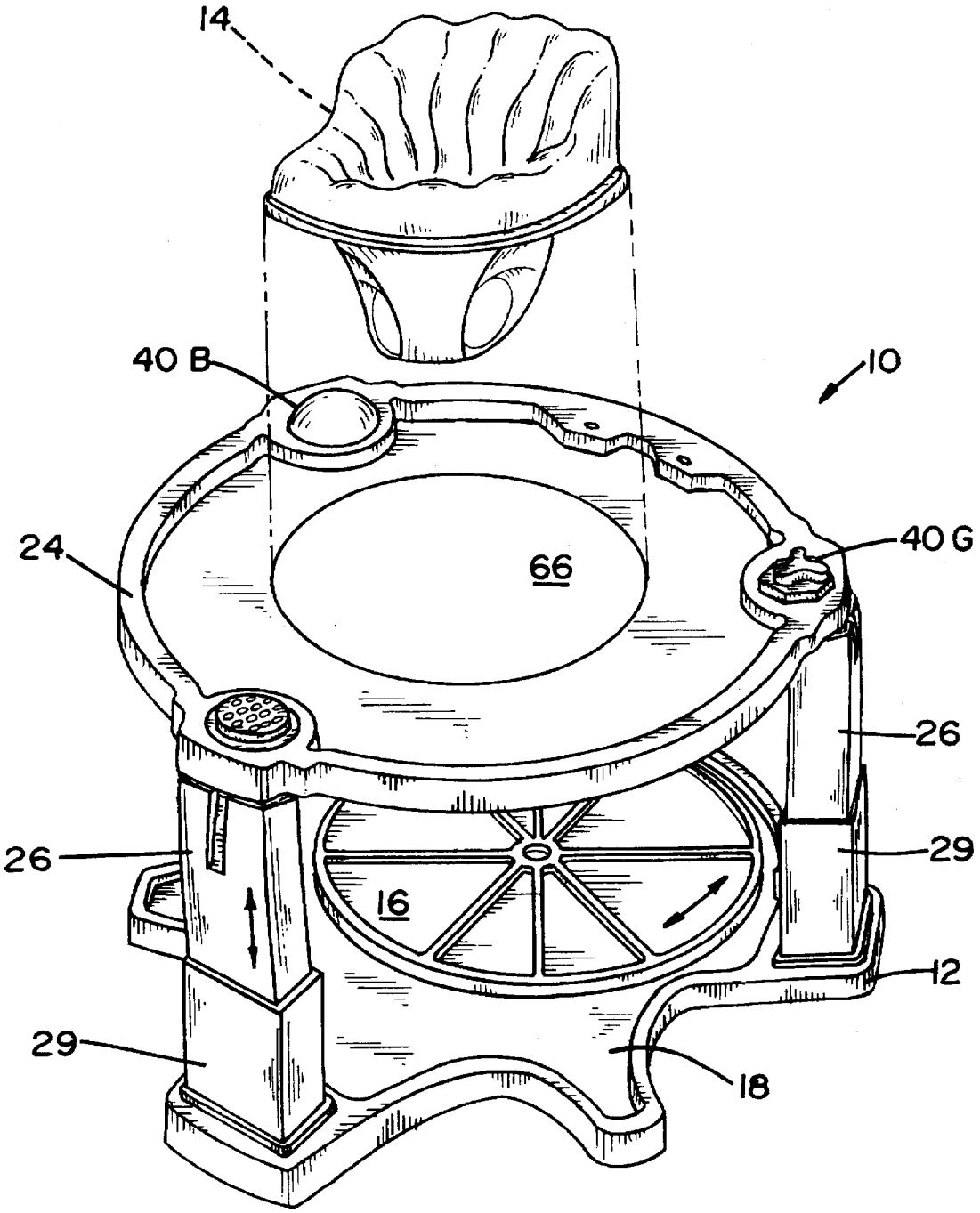
FIG 7 shows the walker of FIG. 1 in perspective view with a cover mounted atop the opening in the upper tray.

With further reference to FIGS. 6 and 7, the walker 10 can be provided with a tray cover 66 for use in place of the body support 14 as an alternative to the table application of FIG. 5. For receiving the tray cover 66, the body support 14 is first removed by releasing the spring-catches 42. The tray cover 66 is formed with counterparts of the spring catches 64 of the platform cover 60 (See FIG. 5.) for engagement in like manner with the tray member 24. In the exemplary configuration of FIG. 6, the tray cover 66 provides a generally flat cover surface 68 that extends over the tray surface 25 and the marginal portion 38 at a height F above the tray surface 25, the height F being only approximately 0.2 inch greater than the height J of the marginal portion 38. The tray cover 66 can be provided with suitable openings 70 for clearing any of the toy elements 40 as might be left assembled with the tray member 24. Preferably the tray cover 66 is also prevented from rotating relative to the tray member 24 by any suitable means, such as by engagement with outward projections 72 of the tray member 24, the projections 72 being associated with connections to the legs 26.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. An infant training walker, comprising:

(a) a base having a horizontally disposed stage surface;

(b) a tread member movably supported relative to the base for rotation about a first axis normal to said stage surface, the tread member having a tread surface for engagement by an infant's foot, at least a portion of the tread surface being movable approximately coplanar with the stage surface; and (c.) a restraint member rotatably supported relative to the base about a second axis parallel with said first axis and in elevated relation to the tread member, said restrain member including means for laterally restraining an infant occupant's torso portion, the restrain member being laterally displaced from said tread member axis of rotation and being effective for at least partially supporting the infant.

2. The walker of claim 1, wherein the restraint member includes a horizontally disposed belt portion, the belt portion defining a clearance opening for receiving the torso portion, the restraint member defining a restraint axis extending vertically within the clearance opening and parallel to the tread member axis of rotation.

3. The walker of claim 2, wherein the restraint axis is horizontally displaced from said tread axis.

4. The walker of claim 3, wherein the tread member has an outside diameter D, and the restraint axis intersects the tread member at a distance E from the tread axis, the distance E being between 15 percent and 30 percent of the diameter D.

5. The walker of claim 4, wherein the distance E is approximately 25 percent of the diameter D.

6. The walker of claim 4, wherein the diameter D is approximately 18 inches and the distance E is approximately 4.5 inches.

7. The walker of claim 3, wherein the tread member comprises a disk member, the tread surface forming a substantially planar upper surface of the disk member.

8. The walker of claim 7, wherein the tread member has an outside diameter D, and one of the base and the tread member has a projecting ring portion, the other of the tread member and the base making sliding contact with the ring portion for movably supporting the tread portion, the sliding contact being within an annulus of major diameter D1 being not greater than approximately 85 percent of the outside diameter D.

9. The walker of claim 8, wherein the ring portion is a first ring portion, including a second ring portion having sliding contact within the annulus, the annulus having a minor diameter D2 being not less than approximately 40 percent of the outside diameter D.

10. The walker of claim 9, wherein the outside diameter D is approximately 18 inches, the diameter D1 is approximately 14.2 inches and the diameter D2 is approximately 9.8 inches.

11. The walker of claim 2, further comprising a plurality of accessory units spaced about the restraint axis outwardly from the belt portion of restraint member in fixed locations relative to the base, each of the accessory units having a handle element associated therewith for assisting the infant to turn relative to the base about the restraint axis.

12. The walker of claim 2, wherein the restraint member is rotatably supported relative to the base about the restraint axis.

13. The walker of claim 12, further comprising a seat element connected to the restraint member for vertically supporting the infant.

14. The walker of claim 13, wherein the seat element includes a cloth member suspended between opposite sides of the belt portion of the restraint member, the seat element having leg openings formed therein for receiving legs of the occupant, the leg openings coupling rotation of the occupant with rotation of the restraint member.

15. The walker of claim 13, wherein the restraint member further comprises a back portion extending upwardly and outwardly from the belt portion for supporting a posterior abdomen portion of the occupant.

16. The walker of claim 15, wherein the restraint member is formed with a registration surface proximate the back portion, the walker further comprising a back-support extension member removably connectable to the restraint member in engagement with the registration surface, the back-support extension member extending upwardly from the back portion when connected to the restraint member for augmenting support of the posterior abdomen portion of the occupant.

17. The walker of claim 1, wherein the base comprises a platform member defining the stage surface, a tray member supporting the restraint member, and a plurality of legs rigidly supporting the tray member in spaced relation to the platform member.

18. The walker of claim 17, wherein the legs are telescopically supported relative to the platform member, the walker further comprising latches for selectively extending each of the legs, thereby adjustably spacing the tray member from the stage surface.

19. The walker of claim 17, wherein the legs are removably connected to the tray member, upper extremities of the legs being adapted for supporting the platform member in an inverted orientation of the legs and platform member, and the walker further comprises a panel connectable to the platform member, the table panel providing an upward-facing table surface in the inverted orientation of the legs and platform member when the panel is connected to the platform member.

20. The walker of claim 17, wherein the restraint member is removably connected to the tray member, the walker further comprising a tray cover removably connectable to the tray member in place of the restraint member, the tray cover providing an upwardly facing table surface extending proximate outer extremities of the tray member when the tray cover is connected to the tray member.

21. An infant training walker, comprising:

a tread member for engagement by an infant's foot and rotatable about a first substantially vertical axis of rotation, and a seat member rotatable about a second substantially vertical axis of rotation for supporting an infant, said seat member being elevated relative to said tread member, and said axes of rotation of said tread member and said seat being laterally offset.

22. The infant training walker of claim 21, and further including a tray member, adjustable leg members for supporting said tray member above said tread member, and a cover member, said tray member including an opening within which said seat member is disposed, and said cover member being configured to lie atop and cover said opening when an infant is not disposed in said seat member.

23. The infant training walker of claim 22, wherein one side of said cover member includes a surface which, when said cover member covers said opening, cooperates with said tray member to define a substantially continuous table surface.

* * * * *